US007303487B2

(12) United States Patent
Kumamoto

(10) Patent No.: US 7,303,487 B2
(45) Date of Patent: Dec. 4, 2007

(54) GOLF CLUB HEAD

(75) Inventor: Tomio Kumamoto, Kobe (JP)

(73) Assignee: SRI Sports Limited, Kobe (JP)

( * ) Notice: Subject to any disclaimer, the term of this patent is extended or adjusted under 35 U.S.C. 154(b) by 203 days.

(21) Appl. No.: 11/079,183

(22) Filed: Mar. 15, 2005

(65) Prior Publication Data

US 2005/0215354 A1 Sep. 29, 2005

(30) Foreign Application Priority Data

Mar. 29, 2004 (JP) ..... 2004-096267

(51) Int. Cl.
*A63B 53/04* (2006.01)

(52) U.S. Cl. ..... 473/345; 473/349

(58) Field of Classification Search ..... 473/345–349
See application file for complete search history.

(56) References Cited

U.S. PATENT DOCUMENTS

| | | | | |
|---|---|---|---|---|
| 1,683,639 | A * | 9/1928 | Vaile | 473/314 |
| 3,595,577 | A * | 7/1971 | Hodge | 473/314 |
| 4,852,880 | A * | 8/1989 | Kobayashi | 473/349 |
| 5,624,331 | A * | 4/1997 | Lo et al. | 473/345 |
| 5,645,495 | A * | 7/1997 | Saso | 473/345 |
| 5,833,551 | A * | 11/1998 | Vincent et al. | 473/350 |
| 6,471,604 | B2 * | 10/2002 | Hocknell et al. | 473/334 |
| 6,491,592 | B2 * | 12/2002 | Cackett et al. | 473/342 |
| 6,572,489 | B2 * | 6/2003 | Miyamoto et al. | 473/291 |
| 6,849,003 | B2 * | 2/2005 | Kumamoto | 473/305 |
| 6,902,497 | B2 * | 6/2005 | Deshmukh et al. | 473/342 |
| 6,929,565 | B2 * | 8/2005 | Nakahara et al. | 473/345 |
| 6,955,612 | B2 * | 10/2005 | Lu | 473/324 |
| 7,008,332 | B2 * | 3/2006 | Liou | 473/345 |
| 2002/0142859 | A1 | 10/2002 | Galloway et al. | |
| 2003/0092500 | A1 * | 5/2003 | Saso | 473/324 |
| 2006/0052181 | A1 * | 3/2006 | Serrano et al. | 473/345 |

FOREIGN PATENT DOCUMENTS

JP 11-4919 A 1/1999

* cited by examiner

*Primary Examiner*—Sebastiano Passaniti
(74) *Attorney, Agent, or Firm*—Birch, Stewart, Kolasch & Birch, LLP

(57) ABSTRACT

A golf club head having face, crown, sole and side portions, and comprising a metal head base body (M) having at least one opening and a cover (FR) arranged in the opening and made of a material having a specific gravity smaller than the base body, wherein when the head is sectioned into head toe side portion (1t) and head heel side portion (1h) by a vertical plane including a normal line drawn from a head center of gravity to a face surface, the surface area of The cover covering a portion of the opening included in the head toe side portion is larger Than the surface area of the cover covering a portion of The opening included in the head heel side portion, and the weight of the head heel side portion (1h) is from 55 to 75% of the entire weight of the head.

10 Claims, 12 Drawing Sheets

GOLF CLUB HEAD

BACKGROUND OF THE INVENTION

The present invention relates to a golf club head which can improve a directionality of a hit ball.

A golf club head is designed such that an accurate distance and directionality can be obtained by hitting a ball by a sweet spot of a face surface. However, actually, it is hard to expect that the ball is accurately hit by the sweet spot by a lot of average golfers except a professional golfer and some seniors, and the golfers having the skill mentioned above generally hit the ball at a position displaced to a toe side or a heel side from the sweet spot of the face surface. In this case, the head generates a micro rotational motion around a gravity point, and a side spin in an inverse direction to the rotational direction of the head is generated in the ball which is in contact with the face surface due to a frictional force. Accordingly, the hit ball is curved to an unintended direction. The operation mentioned above has been known as a gear effect.

Conventionally, in order to improve the directionality of the hit ball, there has been proposed increasing a moment of inertia of the head. The head mentioned above can make the rotational motion mentioned above of the head small even in the case that the ball is hit at the position which is displaced to the toe side or the heel side from the sweet spot of the face surface. For example, in Japanese published application 2003-245382 and Japanese published application H11-4919, there is described a matter that a moment of inertia is increased by employing a low specific gravity material such as a fiber reinforced resin in a part of the head.

The head having a large moment of inertia suppresses deterioration of the directionality, by inhibiting the rotational motion of the head with respect to a miss hit as mentioned above. However, as a state at the time of hitting the ball is shown in time sequence in FIGS. 12A to 12C, a face surface c of a head a tends to be open at the time of hitting a ball b (the face surface c is in a rightward directed state in the case of a right-handed golfer, and so forth). In the ball hit mentioned above, even if the ball b can be hit by the sweet spot of the face surface b, the ball b can not be hit in an intended direction.

A golf swing generally includes an address motion of coming to the ready while adapting the face surface c to a right direction, a take-back motion of swinging the club upward to the highest position (a top position) and a downswing motion of swinging the club downward from the top position. Since the face surface c generally becomes in an open state with respect to a target fly line direction A at the top position, it is necessary to execute a correction motion of turning back the head a to the face surface c so that the open is returned to the correct direction in the address state during the down swing motion from the top position to an impact, in order to correctly hit the ball. Accordingly, the correcting motion is hard to be effectively applied to the head having the great moment of inertia due to the great moment of inertia. As a result, it is considered that the head hits the ball b while the face surface c is kept open.

SUMMARY OF THE INVENTION

The present invention is made by taking the actual condition mentioned above into consideration, and an object of the present invention is to provide a golf club head serving for improving a directionality of a hit ball, on the basis of a golf club head structured such as to include a head base body made of a metal material having at least one opening portion, and a cover body arranged in the opening portion and made of a low specific gravity material, and structured such that a surface area St of the cover body covering the opening portion included in a head toe side portion is made larger than a surface area Sh of the cover body covering the opening portion included in a head heel side portion, and a weight of the head heel side portion is limited with respect to the entire weight of the head.

In a golf head according to the present invention, the golf club head includes a head base body made of a metal material and provided with at least one opening portion, and a cover body arranged in the opening portion and made of a lower specific gravity material having a specific gravity smaller than said metal material. The opening portion includes at least one of a crown opening portion open in the crown portion, a side opening portion open in the side portion and a sole opening portion open in the sole portion.

In a head toe side portion and a head heel side portion obtained by virtually sectioning the head by a vertical surface including a normal line drawn from the head gravity point to the face surface in a standard state of being mounted on a horizontal surface at prescribed lie angle and loft angle, a surface area St of a cover body closing the opening portion in the head toe side portion is made larger than a surface area Sh of a cover body closing the opening portion in the head heel side portion, and a weight Wh of the head heel side portion is set to 55 to 75% of the entire weight of the head.

The golf club head mentioned above can improve a turn-back of the face surface in the down swing motion from the top to the impact. Accordingly, since it is possible to hit the ball in the address state or a direction of the face surface similar thereto, the directionality of the hit ball is improved.

In the golf club, a specific gravity of the low specific gravity material may be 1.0 to 2.0, and a specific gravity of the metal material May be 4.0 to 10.0. Also, the low specific gravity material may be constituted by a fiber reinforced resin.

The moment of inertia around a vertical axis passing through a head gravity point may be 3300 to 5500 ($g \cdot cm^2$), and a head volume is 300 to 500 ($cm^3$), and the opening portion is structured such that the crown opening portion, the side opening portion and the sole opening portion are connected, and is constituted by one extending to the sole portion from the crown portion across the side portion on a rear side of the head.

BRIEF DESCRIPTION OF THE DRAWINGS

FIGS. 8A and 8B show a head in accordance with another embodiment of the present invention, wherein FIG. 8A is a plan view of a standard state, and FIG. 8B is a bottom plan view of the same;

FIGS. 9A and 9B show a head in accordance with another embodiment of the present invention, wherein FIG. 9A is a plan view of a standard state, and FIG. 9B is a bottom plan view of the same;

FIGS. 10A and 10B show a head in accordance with another embodiment of the present invention, wherein FIG. 10B is a bottom plan view of the same;

FIGS. 11A and 11B show a head in accordance with a comparative embodiment, wherein FIG. 11B is a bottom plan view of the same.

DESCRIPTION OF THE PREFERRED EMBODIMENTS

Figure 1:
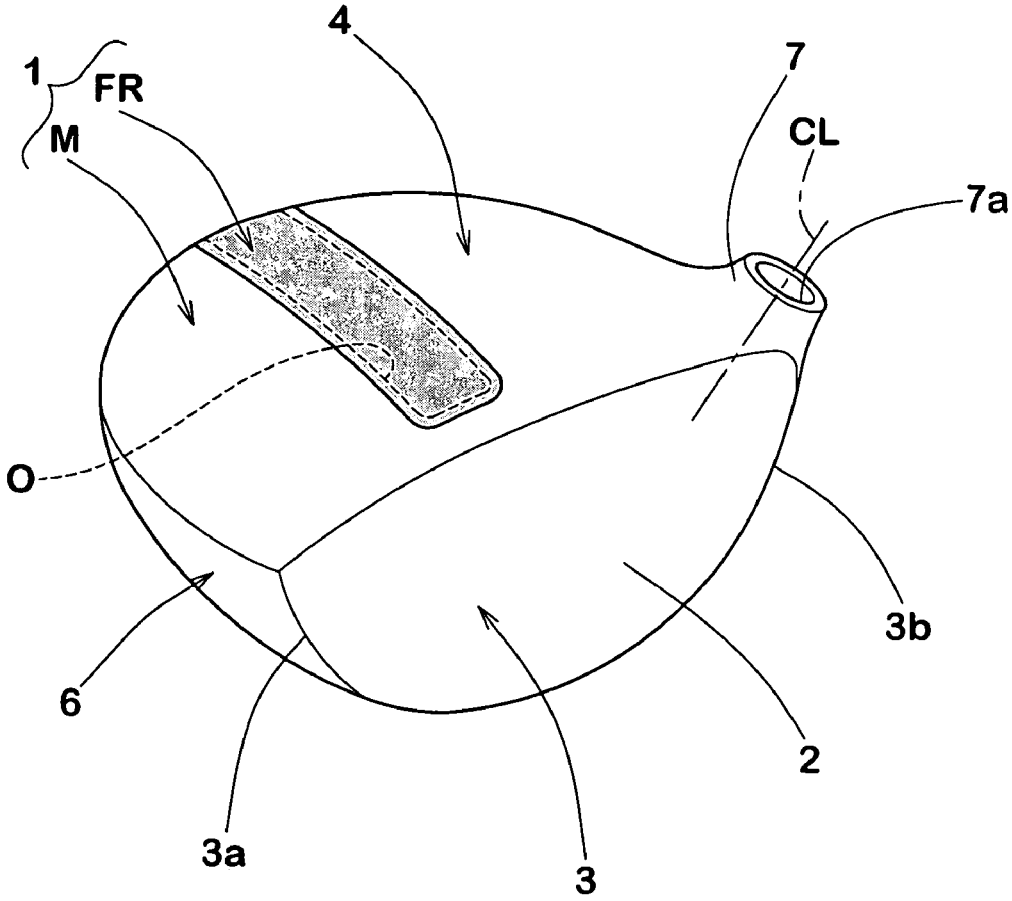
FIG. 1 is a perspective view of a standard condition of a head showing an embodiment in accordance with the present invention.
Figure 2A:
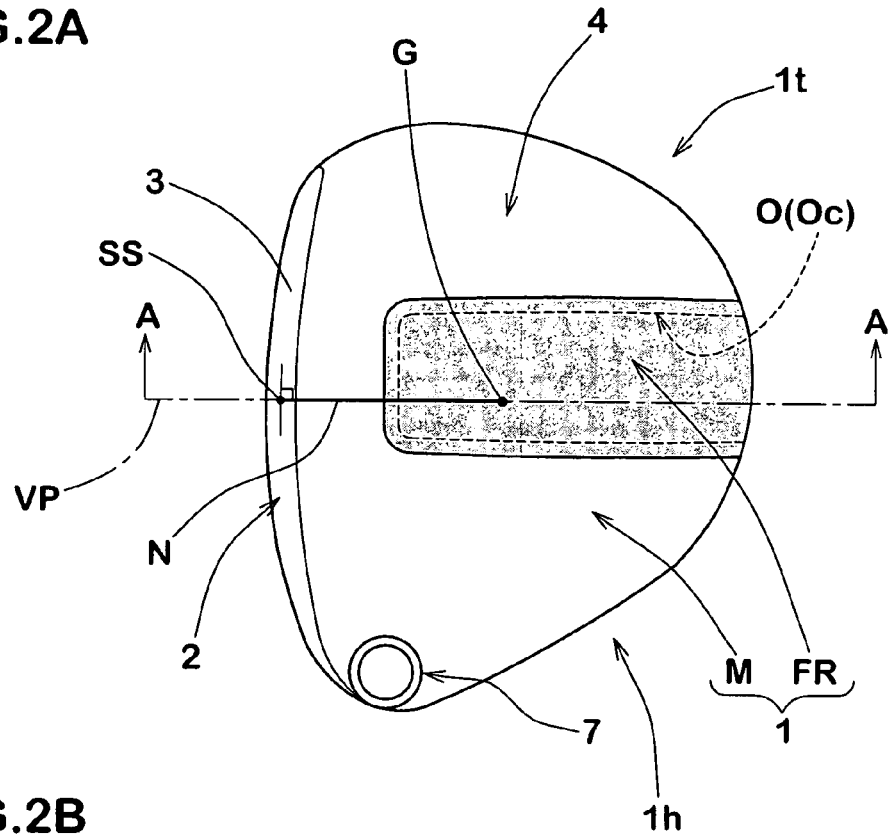
FIG. 2A is a plan view of the same.
Figure 2B:
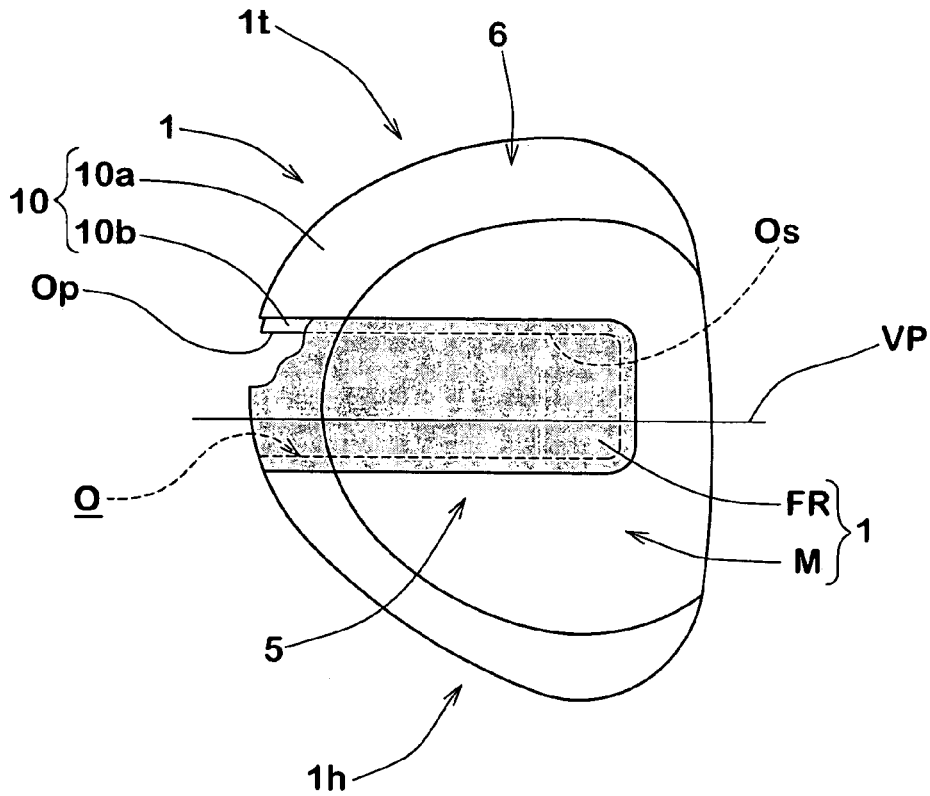
FIG. 2B is a bottom plan view of the same.
Figure 3:
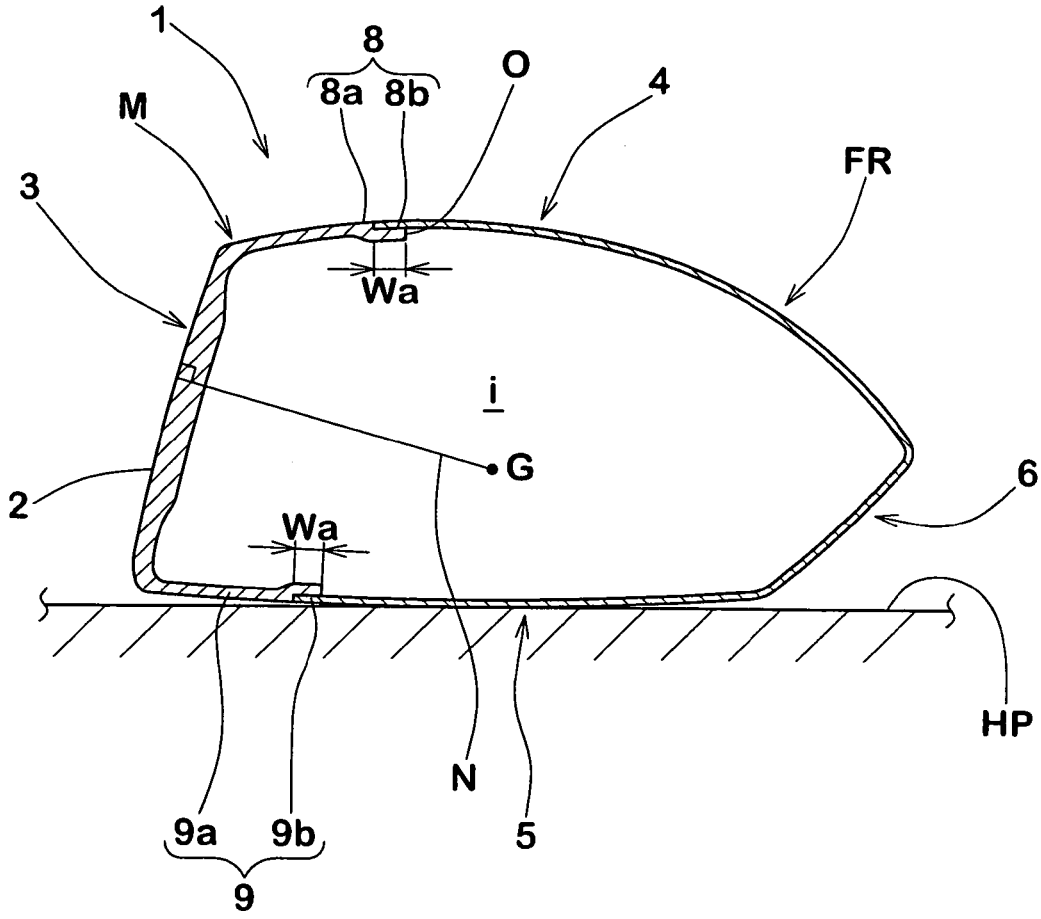
FIG. 3 is a cross sectional view along a line A-A in FIG. 2.

Embodiments of the present invention will now be described in detail in conjunction with the accompanying drawings. FIG. 1 shows a basic state in which a golf club head 1 (hereinafter, this may be sometimes called simply as "head") according to the present embodiment is grounded on a horizontal surface at a prescribed lie angle and loft angle(real loft angle), FIG. 2A is a plan view of the same, FIG. 2B is a bottom plan view of the same, and FIG. 3 is a cross sectional view along a line A-A in FIG. 2. The horizontal surface is indicated by HP in FIG. 3.

In the drawings, a head 1 in accordance with the present embodiment is provided with a face portion 3 having a face surface 2 corresponding to a surface hitting a ball, a crown portion 4 connected to the face portion 3 and forming a head upper surface, a sole portion 5 connected to the face portion 3 and forming a head bottom surface, a side portion 6 joining between the crown portion 4 and the sole portion 5 and extending to a heel 3*b* from a toe 3*a* of the face portion 3 through a back face, and a neck portion 7 provided in a heel side of the crown portion 4 and to which one end of a shaft (not shown) is attached, and is exemplified by a wood type head such as a driver (#1) or a fairway wood having a hollow structure provided with a hollow portion i in an inner portion.

In this case, the lie angle can be set on the assumption that an axial center line CL of a shaft insertion hole 7*a* provided in a neck portion 7 is a shaft axis.

Further, the head 1 is structured such as to include a head base body M which is made of a metal material and is provided with at least one opening portion O, and a cover body FR which is arranged in the opening portion O and is made of a low specific gravity material having a smaller specific gravity than that of the metal material.

The opening portion O of the head base body M includes a crown opening portion Oc which is open in the crown portion 4, a side opening portion Op which is open in the side portion 6, and a sole opening portion Os which is open in the sole portion 5, and this embodiment is exemplified by a structure in which the crown opening portion Oc, the side opening portion Op and the sole opening portion Os are connected to each other, thereby forming one opening portion O. Since the opening portion O mentioned above is structured such that the opening portions are respectively provided in a dispersed manner in the crown portion 4, the sole portion 5 and the side portion 6, the structure is preferable in a point that a great opening area can be obtained by the head base body M while restricting a reduction in strength of each of the portions to the minimum, improves a freedom of designing a weight distribution and serves for adjusting a moment of inertia.

Further, since the opening portion O in accordance with the present embodiment is formed in a band shape which extends at a substantially fixed width to the sole portion 5 across the side portion 6 on a back side (a back face side) of the head from the crown portion 4, it is possible to effectively distribute the weight of the head base body M on both sides of the opening portion O, that is, a toe side and a heel side. This structure is preferable in a point of particularly serving for increasing a moment of inertia around a vertical axis passing through the head gravity point G mentioned below.

The head base body M according to the present embodiment is exemplified by a metal member structured, such as to include a face portion 3, a neck portion 7, a crown main wall portion 8 forming a main portion of the crown portion 4, a sole main wall portion 9 forming a main portion of the sole portion 5, and a side main wall portion 10 forming a main portion of the side portion 6. Further, the head base body M according to this embodiment is integrally formed in each of the portions by casting. Further, according to another embodiment, the metal member (head base body) M is formed by forming two or more parts according to a working method such as forging, casting, pressing or rolling and thereafter integrally bonding them according to a welding or the like. In case of the casting, since the neck portion 7 and the face portion 3 which defines the lie angle and the loft angle are integrally formed without welding, it is useful to finishing with sufficient accuracy.

Further, the metal material forming the head base body M is not particularly limited, however, can employ, for example, a stainless steel, a maraging steel, a titanium, a titanium alloy, an aluminum alloy, a magnesium alloy, an amorphous alloy or the like. Especially, a titanium alloy, an aluminum alloy or a magnesium alloy, having a large specific strength, is desirable. Especially, the material having specific gravity, more than 4.0 is preferably and more than 4.2 more preferably, and about a maximum specific gravity is below than 10.0 is preferably and below 8.0 more preferably.

Further, the head base body M may be formed by using two or more kinds of metal materials, without being limited to be formed by one metal material. The present example is exemplified by a structure in which the titanium alloy is employed as the head base body M. For the metal materials, for example, mild steel (7.9), stainless steel (7.8-8.2), pure titanium (4.5), T1-6Al-4V (4.4), Ti-20V-4Al-1Sn (4.8), Ti-4.5Al-3V-2Fe-2Mo (5.0), Ti-15Mo-5Zr-3Al (4.5), or Ti-15V-3Sn-3Al (4.7), each having the specific gravity shown in the parentheses, may be used preferably.

As a titanium alloy, the titanium alloy of $\alpha+\beta$ system, or that of $\beta$ system alloy, for example, T1-6Al-4V, Ti-4.5Al-3V-2Fe-2Mo, Ti-2Mo-1.6V-0.5Fe-4.5Al-0.3Si-0.03C, Ti-15V-3Cr-3Al-3Sn, Ti-15Mo-5Zr-4Al-4V, Ti—Ti-15V-6Cr-4Al, Ti-20V-4Al-1Sn can be adopted preferably. To obtain the metal material of the invention, it is possible to combine two or more different metal materials.

Further, the cover body FR in accordance with the present embodiment is exemplified by a structure made of a fiber reinforced resin corresponding to the low specific gravity material. The fiber reinforced resin corresponds to a composite material comprising a matrix resin and a fiber serving as a reinforcing material thereof, and has a smaller specific gravity in comparison with the head base body M made of a metal material. Accordingly, it is possible to obtain a greater weight saving effect by employing the cover body FR made of the low specific gravity material mentioned above. Further, the saved weight is, for example, consumed for making a size of the head base body M larger and is distributed to an appropriate position on the basis of a thickness design of the head base body M, whereby it is possible to adjust a position of the head specific gravity G and a moment of inertia, and it is possible to increase a freedom of weight distribution design.

Further, the low specific gravity material constituting the cover body FR is not particularly limited, however, if the specific gravity is too large, there is a tendency that the weight saving effect mentioned above and the like can not be sufficiently obtained. From this point of view, it is desirable that the specific gravity of the low specific gravity material is equal to or less than 2.0, more preferably equal to or less than 1.8. In this case, a lower limit thereof is not particularly limited, however, since there is a tendency that the strength is lowered if the specific gravity is too small, it is desirable, for example, that the lower limit is equal to or more than 1.0.

The kind of the matrix resin is not particularly limited, however, it is desirable to employ a thermosetting resin, for example, an epoxy resin, a phenol resin and the like, and a thermoplastic resin such as a nylon resin, a polycarbonate resin and the like. Further, the fiber is not particularly limited, however, it is possible to employ an organic fiber, for example, a carbon fiber, a glass fiber, an aramid fiber and a polyphenylene benzoxazole resin fiber (PBO fiber), or a metal fiber such as an amorphous fiber, a titanium fiber and the like, and especially, the carbon fiber having a small specific gravity and a large tensile strength is preferable.

Further, an elastic modulus of the fiber is not particularly limited, however, if it is too small, it is impossible to secure a rigidity of the resin member FR and a durability tends to be lowered, and if it is inversely too large, the cost thereof is increased, and a tensile strength tends to be lowered. From this point of view, it is desired that the elastic modulus of the fiber is equal to or more than 50 GPa, more preferably equal to or more than 100 GPa, further preferably equal to or more than 150 GPa, and particularly preferable equal to or more than 200 GPa. Further, it is desirable that an upper limit is preferably equal to or less than 550 GPa, more preferably equal to or less than 450 GPa, and further preferably equal to or less than 350 GPa. In this case, the elastic modulus of the fiber corresponds to an elastic modulus in tension, and is constituted by a value measured in accordance with "carbon fiber test method" in JIS R7601. Further, in the case that two or more kinds of fibers are contained, there is employed an average elastic modulus obtained by calculating the elastic modulus of each of the fibers by weighing on the basis of a weight ratio, as shown by the following expression (1).

$$\text{Average elastic modulus}=\Sigma(Ei\cdot Vi)/\Sigma vi \quad (i=1,2\ldots)$$

(wherein Ei is an elastic modulus of a fiber i, and Vi is a total weight of the fiber i)

Further, in accordance with the present embodiment, as shown in FIG. 3, the aforesaid crown main wall portion 8 of the head base body M includes a crown surface portion 8*a* which forms an outer surface portion of the crown portion 4, and a crown receiving portion 8*b* which is formed between the crown surface portion 8*a* and the opening portion O and is depressed to the hollow portion i side while a surface thereof has a step from the crown surface portion 8*a*. Further, the sole main wall portion 9 also includes a sole surface portion 9*a* which forms an outer surface portion of the sole portion 5, and a sole receiving portion 9*b* which is formed between the sole surface portion 9*a* and the opening portion O and is depressed to the hollow portion i side while a surface thereof has a step from the sole surface portion 9*a*. In the same manner, the side main wall portion 10 also includes a side surface portion 10*a* which forms an outer surface portion of the side portion 10, and a side receiving portion 10*b* which is formed between the side surface portion 10*a* and the opening portion O and is depressed to the hollow portion i side while a surface thereof has a step from the side surface portion 10*a*, as shown in FIG. 2B.

Respective the receiving portion 8*b*, 9*b*, or 10*b* can hold an inner surface side of the cover body FR at a peripheral edge portion thereof. Further, the receiving portion 8*b*, 9*b*, and 10*b* absorbs a thickness of the cover body FR on the basis of the step mentioned above, and serves for finishing the surface portions 8*a*, 9*a*, 10*a* and the cover body FR flush.

The receiving portion 8*b*, 9*b*, or 10*b* of the head base body M and the cover body FR is bonded therebetween. The receiving portion 8*b*, 9*b*, 10*b* in accordance with the present embodiment is continuously and annularly provided in the entire periphery around the opening portion O. As a result, it is possible to bond and hold the entire periphery of the peripheral edge portion of the cover body FR. In this embodiment, the cover body FR is continuously and annularly bonded around the opening portion O. However, receiving portions 8*b*, 9*b*, and 10*b* are not limited to such structure, a part or parts of receiving portions 8*b*, 9*b*, and 10*b* may be broken off around the opening portion O. In the preferred embodiment, a ratio of the total length of the receiving portions 8*b*, 9*b*, and 10*b* to the length around opening portion O is equal to or more than 60%, preferably 70%, and more preferably 80%. Thereby, the area of the bonding portion between the cover body FR and head base body, is fully secured and is useful to obtaining stronger adhesion intensity.

A width Wa of the receiving portion 8*b*, 9*b*, or 10*b* (measured in a perpendicular direction from an edge of the opening portion O) is not particularly limited, however, if it is too small, the bonding area between the head base body M and the cover body FR becomes small, whereby a bonding strength tends to be lowered, and if it is inversely too large, the area of the opening portion O becomes small, whereby there is a tendency that the weight saving effect can not be sufficiently obtained. From this point of view, it is desirable that the width Wa of the receiving portions 8*b*, 9*b*, and 10*b* are, for example, equal to or more than 5 mm, and more preferably equal to or more than 10 mm, and it is desirable that the upper limit is equal to or less than 30 mm, and more preferably equal to or less than 20 mm. The width Wa may be constant, or may be varied.

Further, the cover body FR can be formed in accordance with various methods. For example, the cover body FR can be obtained by applying a predetermined heat and pressure to a laminated body obtained by laminating, for example, one to a plurality of, more preferably about two to ten sheets of prepregs so as to form in a desired shape. The formed cover body FR is firmly fixed to each of the receiving portions 8*b*, 9*b* and 10*b*, for example, by using an adhesive agent or the like. Further, the cover body FR can be injection molded by charging a liquid compound material obtained by mixing the fiber or the other necessary compounding agent to the liquid resin matrix into a cavity of a metal mold in accordance with a direct injection or the like.

Further, the cover body FR can be integrally formed in the head base body M by using an internal pressure molding method or the like.

Figure 4A:
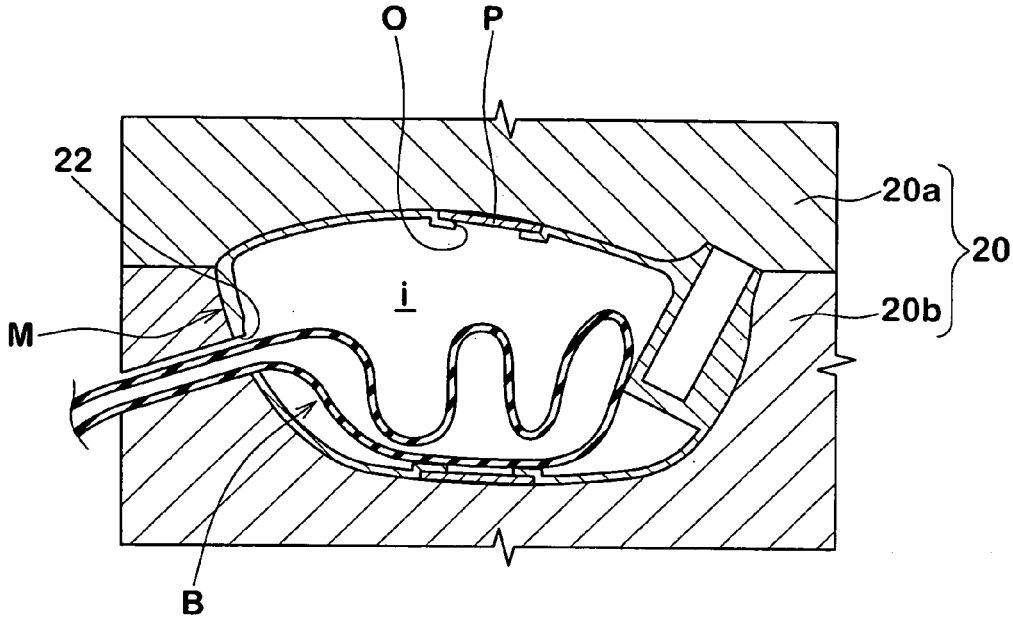
FIGS. 4A and 4B are cross sectional views explaining an internal pressure molding method.

According to the internal pressure molding method, as shown in FIG. 4A, the first step is the preliminarily molding step in which by arranging the laminated body P of the prepreg constituted by a plurality of sheets in the opening O of the head base body M so as to cover the opening O. Further, in the case that, for example, a thermosetting type adhesive agent, a resin primer or the like is previously applied between the laminated body P of the prepreg and the receiving portions 8*b* 9*b*, and 10*b*, it is possible to prevent both the members from being displaced and it is possible to improve a molding accuracy.

Next, the base head body M equipped with the laminated body P is put in a metal mold 20, for example, constituted by a pair of detachable upper mold 20*a* and lower mold 20*b*. Further, it is desirable that the metal member M is previously provided with a through hole 22 communicating with a hollow portion i. In this example, there is shown a structure in which the through hole 22 is provided in the side portion 6, however, the structure is not limited to this aspect. Further, a bladder B is inserted to the hollow portion i from the through hole 22. The bladder B is structured such as to freely expand and contract on the basis of incoming and outgoing of the pressurized fluid.

Figure 4B:
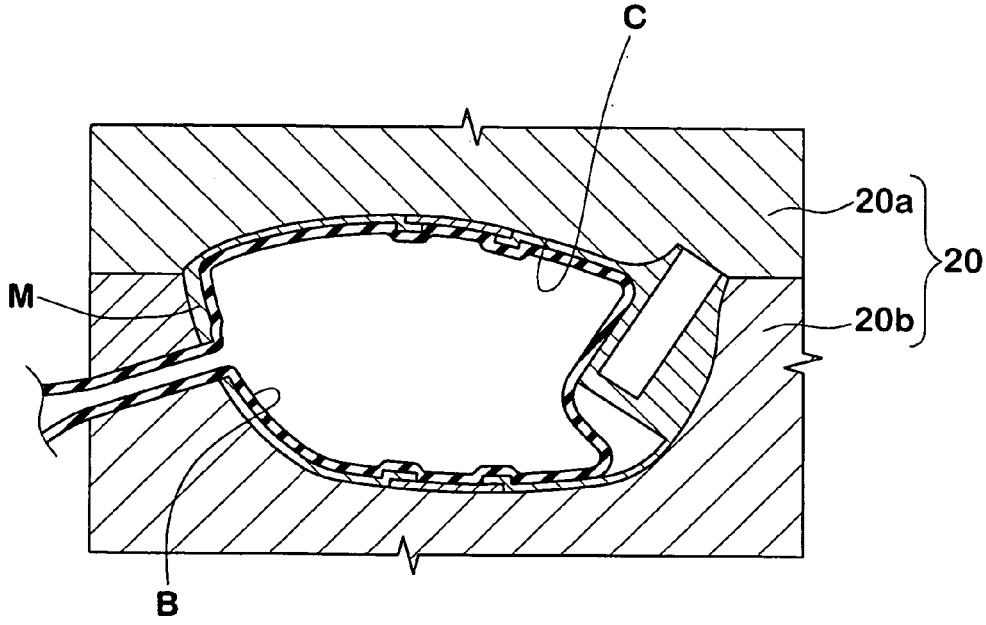

Thereafter, as shown in FIG. 4B, the metal mold 20 is heated, and there is executed the internal pressure molding step of expanding and deforming the bladder B in the hollow portion i. Accordingly, the laminated body P of the prepreg sheet exposed to the heat and the pressure from the bladder B is deformed along a cavity C and be molded to the desired cover body FR, and a peripheral edge portion of the laminated body P is integrally adhered to the receiving portions 8*b*, 9*b*, and 10*b*. In this case, after molding the prepreg, the bladder B is deflated so as to be taken out from the through hole 22. The through hole 22 is closed by a badge, cover or the like provided with a trade name of the head, an ornamental pattern or the like, in the later step.

Figure 5A:
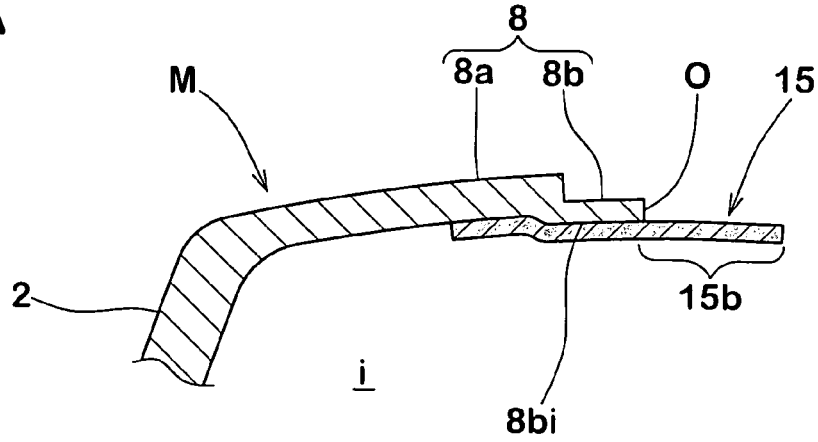
FIG. 5 is a partial cross sectional view of a head base body showing another embodiment of the internal pressure molding method.

Further, in the case of using the internal pressure molding method, for example, as shown in FIG. 5A, it is desirable to previously attach an auxiliary prepreg 15 to an inner surface 8*bi* directed in a side of the hollow portion of the receiving portion 8*b*, 9*b*, or 10*b* (the crown receiving portion 8*b* is exemplified in this example), in the opening portion O of the metal member M. The auxiliary prepreg 15 is attached to the inner surface 8*bi* of the crown receiving portion 8*b* with a protruding portion 15*b* protruding to the opening portion O side from an edge of the opening portion O. Further, the auxiliary prepreg 15 is provided, for example, at least in a part of the periphery of the opening portion O, however, it is desirable that the auxiliary prepreg 15 is annularly and continuously attached to the periphery of the opening portion O.

Figure 5B:
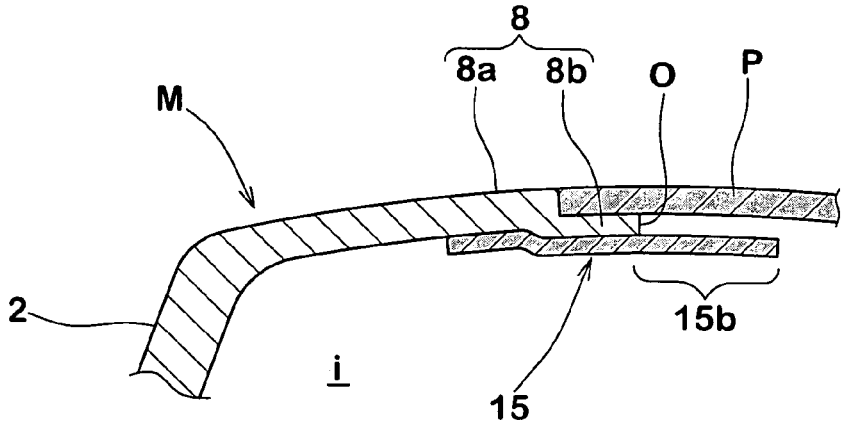
Figure 5C:
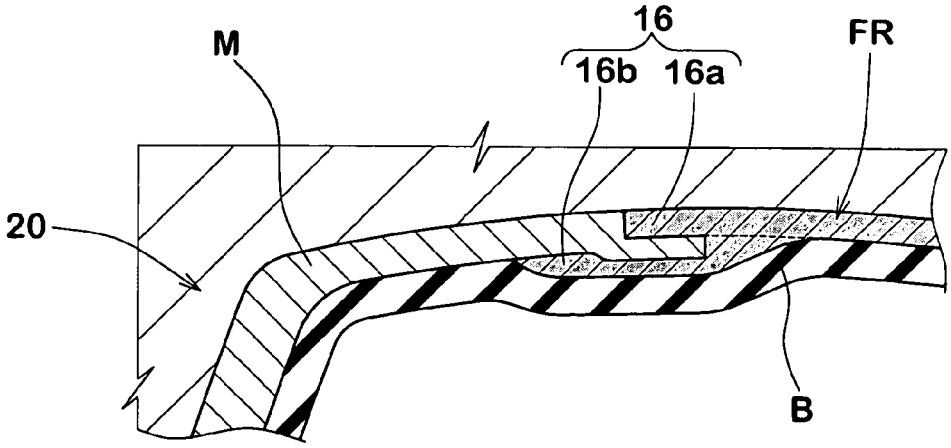

Next, as shown in FIG. 5B, the laminated body P of the prepreg is attached to the receiving portions 8*b*, 9*b*, and 10*b* so as to cover the opening portion O, however, at this time, for example, it is possible to temporarily bond the protruding portion 15*b* of at least one auxiliary prepreg 15 to the inner surface of the laminated body P of the prepreg. Further, as shown in FIG. 5C, the peripheral edge portion of the cover body FR can be molded as a bifurcated portion 16 having an outer piece portion 16*a* extending along an outer surface side of the crown receiving portion 8*b* and an inner piece portion 16*b* extending along an inner surface side of the receiving portion 8*b*, by executing the internal pressure molding within the metal mold 20. As mentioned above, it is possible to increase a bonding area between the cover body FR and the head base body M according to a simple procedure and it is possible to manufacture the head 1 having a firm bonding strength, by including a step of previously arranging the auxiliary prepreg 15 having the protruding portion 15*b* on the inner surface side of the crown receiving portion 8*b*, and/or the sole receiving portion 9*b*, and/or the side receiving portion 10*b* at a time of manufacturing the composite head.

The head 1 in accordance with the present invention is structured, as shown in FIG. 2A, such that in a head toe side portion 1*t* and a head heel side portion 1*h* obtained by virtually sectioning the head by a vertical surface VP including a normal line N drawn to the face surface 2 from the head gravity point G in the standard state mentioned above, a surface area St of the cover body FR closing the opening portion O in the head toe side portion 1*t* is made larger than a surface area Sh of the cover body closing the opening portion O in the head heel side portion 1*h*, and a weight Wh of the head heel side portion is set to 55 to 75% of the head total weight W. In this case, it is assumed that each of the surface areas Sh and St of the cover body does not include the surface area of a portion bonded to each of the receiving portions 8*b*, 9*b* and 10*b*.

The conventional weight distribution design of the head 1 is achieved by optimizing the thickness of each of the portions or adding a heavy load (for example, a weight body made of a high specific gravity material or the like), however, these methods prevent a volume of the head from being increased. In accordance with the present invention, the surface area St of the cover body FR closing the opening portion O in the head toe side portion 1*t* is made larger than the surface area Sh of the cover body closing the opening portion O in the head heel side portion 1*h*. Accordingly, the head 1 of the present invention can employ a lot of low specific gravity material in the head toe side portion 1*t* while intending to make the head volume large. As a result, it is possible to distribute a lot of weight in the head heel side portion 1*h* while promoting the light weight of the head toe side portion 1*t*.

Further, although not particularly limited, in order to optimize a rate of the weight of the head heel side portion 1*h* with respect to the head total weight, it is desirable that a percentage of a ratio (Sh/St) between the surface area St of the cover body FR closing the opening portion O in the head toe side portion 1*t*, and the surface area Sh of the cover body closing the opening portion O in the head heel side portion 1*h* is preferably equal to or more than 10%, and more preferably equal to or more than 30%, and it is desirable that an upper limit thereof is preferably equal to or less than 80%, and more preferably equal to or less than 70%. Further, if a sum of the surface area (Sh+St) of the cover body FR mentioned above is too small, there is a tendency that it is impossible to execute a sufficient weight reduction and weight distribution design.

On the other hand, if the sum (Sh+St) of the surface area is too large, there is a tendency that the strength of the head base body M is lowered and a durability is deteriorated. From this point of view, it is desirable that the sum (Sh+St) of the surface area of the cover body FR is equal to or more than 20% of the head total surface area measured in a state of closing the shaft insertion hole 7*a* mentioned above, and more preferably equal to or more than 25%, and it is desirable that an upper limit thereof is equal to or less than 70%, and more preferably equal to or less than 65%.

Further, the surface area St of the cover body closing the opening portion O in the head toe side portion 1*t* corresponds to a total value of a surface area St1 of the cover body closing a crown opening portion Oc, a surface area St2 of the cover body closing a sole opening portion Os and a surface area St3 of the cover body closing a side opening portion Op, in the head toe side portion 1*t*. In the same manner, the surface area Sh of the cover body closing the opening portion O in the head heel side portion 1*h* corresponds to a total value of a surface area Sh1 of the cover body closing the crown opening portion Oc, a surface area Sh2 of the cover body closing the sole opening portion Os and a surface area Sh3 of the cover body closing the side opening portion Op, in the head heel side portion 1*h*. Further, in accordance with a particularly preferable aspect, it is desirable that the head 1 satisfies the following expressions (1), (2) and (3). Accordingly, it is possible to reduce the weight of the head toe side portion 1*t* with a good balance in each of the crown portion 4, the sole portion 5 and the side portion 6, whereby it is possible to prevent the strength reduction from being deviated.

$$St1 > Sh1 \quad (1)$$

$$St2 > Sh2 \quad (2)$$

$$St3 > Sh3 \quad (3)$$

(in this case, Sh1≠0, Sh2≠0 and Sh3≠0)

Figure 6:
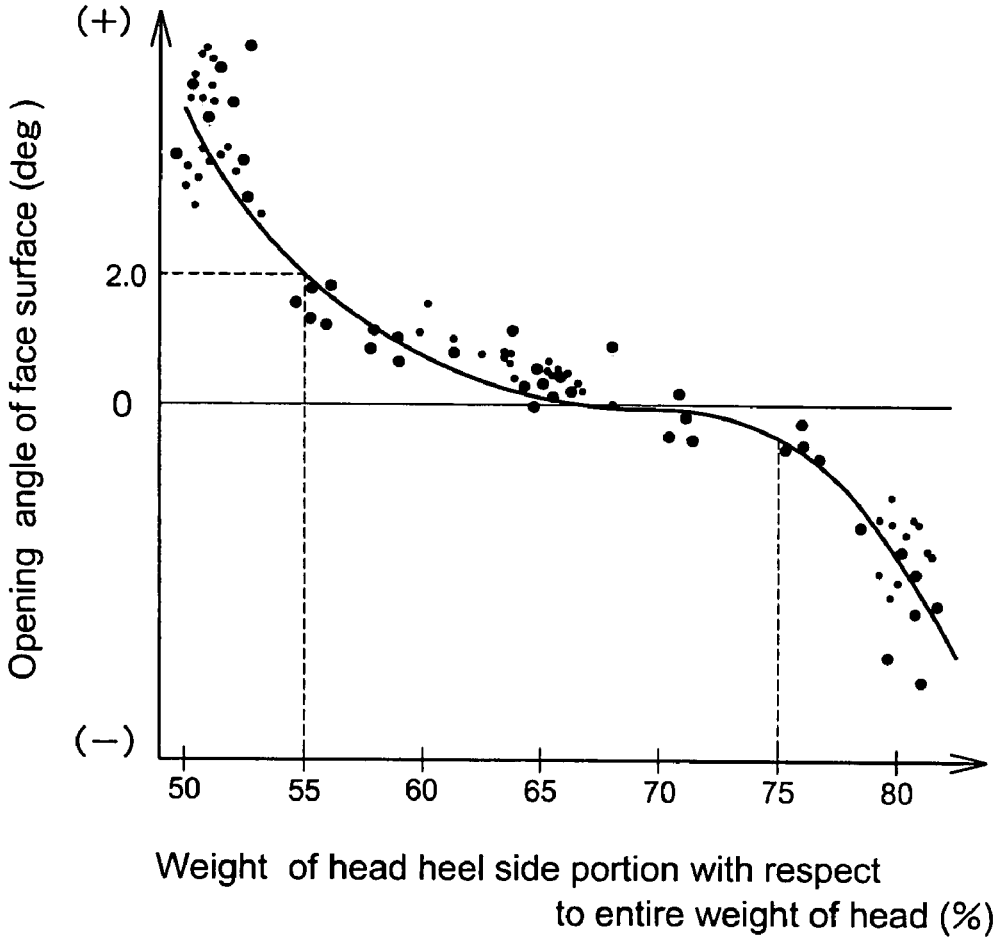
FIG. 6 is a graph showing a relation between an opening angle of a face surface and a weight of a head heed side portion.

Further, the inventors have carried out various experiments about the turning back of the head 1, or the face surface 2 at the time of downswing mentioned above. FIG. 6 shows results obtained by carrying out a ball hitting test covering thirty average golfers having a head speed of 35 to 43 m/s and measuring an opening angle of the face surface at the time of impact. In this drawing, an opening angle (deg) of the face surface 2 just before the impact is shown in a vertical axis, and a rate (%) of a weight Wh of the head heel side portion 1*h* with respect to the head total weight W is shown in a horizontal axis. The head is structured on the basis of the head shown in FIG. 1, however, is structured such that the magnitude of the opening portion O is variously changed and the weight rate mentioned above is changed. Further, in the opening angle of the face surface 2, plus display shows that the opening angle is open with respect to a target, and minus display shows that the opening angle is closed. In this case, the head volume is set to 320 $cm^3$.

From the experiments mentioned above, in order to improve the turning back of the face surface 2, the inventors have found that the weight rate of the head heel side portion 1*h* close to the shaft side is very important. Further, the inventors have found that the rate (%) of the weight Wh of the head heel side portion is equal to or more than 55% of the head total weight, more preferably equal to or more than 60% and further preferably equal to or more than 65%, and an upper limit is preferably equal to or less than 75%, and more preferably equal to or less than 70%. In other words, if the rate (%) of the weight Wh of the head heel side portion is less than 55% of the head total weight, the head toe side portion 1*t* is too heavy for the average golfer having this kind of head speed and it is hard to turn back the head, and the opening angle of the face surface 2 becomes larger than 2.00 deg. by extension. On the contrary, if the rate (%) of the weight Wh of the head heel side portion exceeds 75%, the head heel side portion 1*h* becomes significantly heavy for this kind of golfer. Accordingly, the head 1 tends to be turned back excessively. Further, since the ball is hit in a state in which the face surface 2 is closed, the hit ball tends to be deviated in a leftward direction. In this case, in the conventionally general head, the rate (%) of the weight Wh of the head heel side portion is approximately 50% of the head total weight.

Figure 7:
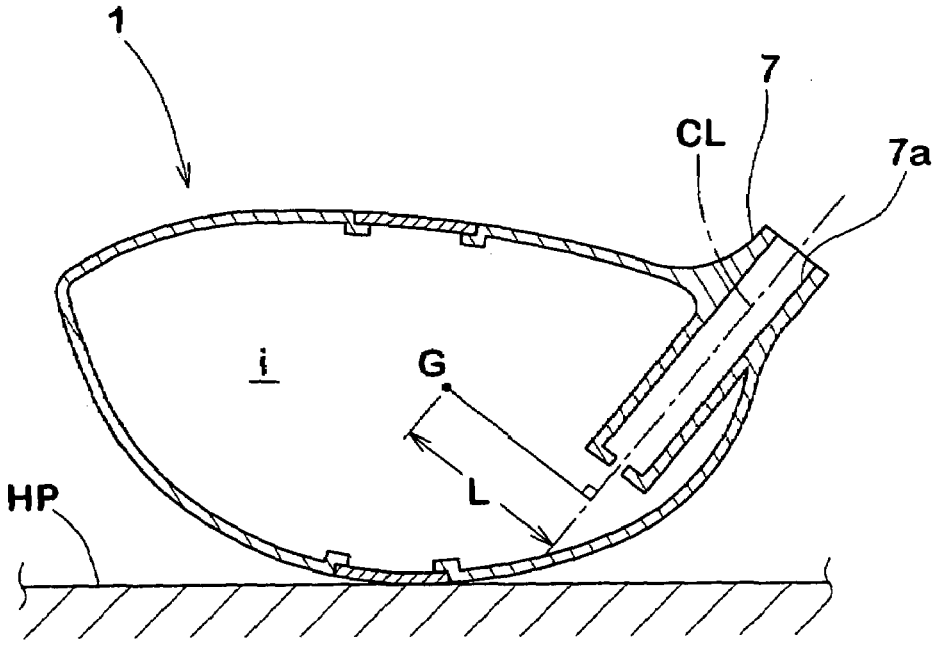
FIG. 7 is a cross sectional view explaining a distance of gravity point.

Further, in accordance with the present invention, a position of the head gravity point G is not particularly limited, however, as shown in FIG. 7, it is desirable to limit a distance L of gravity point corresponding to a shortest distance from the head gravity point G to an axial center line CL of the shaft insertion hole 7*a*. The distance L of gravity point tends to form a preliminary standard of an easiness of the turning back of the head 1 at the time of downswing. If this value is too large, the face surface 2 is hard to be turned back at the time of downswing, and on the contrary, if this value is too small, the face surface 2 is excessively easily turned back. From this point of view, it is desirable that the gravity point distance L is equal to or more than 20 mm, more preferably equal to or more than 25 mm, and further preferably equal to or more than 27 mm, and it is desirable that an upper limit thereof is preferably equal to or less than 45 mm, more preferably equal to or less than 40 mm, and further preferably equal to or less than 38 mm.

Further, in the head 1, in the standard state, if the moment of inertia around the vertical axis passing through the head gravity point G is too small, the rotational motion of the head 1 becomes larger and the directionality of the hit ball tends to be lowered, at a miss shot time of hitting the ball at a position which is apart from a sweet spot SS of the face surface 2. On the contrary, if the moment of inertia is too large, there is a tendency that the face surface 2 is hard to be turned back at the time of downswing, and the ball tends to be deviated in a rightward direction. From this point of view, it is desirable that the moment of inertia is preferably equal to or more than 3300 ($g \cdot cm^2$), more preferably equal to or more than 3500 ($g \cdot cm^2$), and further preferably equal to or more than 3600 ($g \cdot cm^2$), and an upper limit thereof is preferably equal to or less than 5500 ($g \cdot cm^2$), more preferably equal to or less than 5200 ($g \cdot cm^2$), and further preferably equal to or less than 5000 ($g \cdot cm^2$).

Further, the volume of the head 1 is not particularly limited, however, if the volume is too small, a sense of comfort can not be obtained when ready to hit the ball, and there is a tendency that the moment of inertia mentioned above is made smaller. On the contrary, if the head volume is too large, there is a tendency that the moment of inertia per se is excessively increased. From this point of view, it is desirable that the head volume is preferably equal to or more than 300 $cm^3$, more preferably equal to or more than 320 $cm^3$, and further preferably equal to or more than 340 $cm^3$, and it is desirable that an upper limit thereof is preferably equal to or less than 500 $cm^3$, more preferably equal to or less than 480 $cm^3$, and further preferably equal to or less than 460 $cm^3$.

Figure 8A:
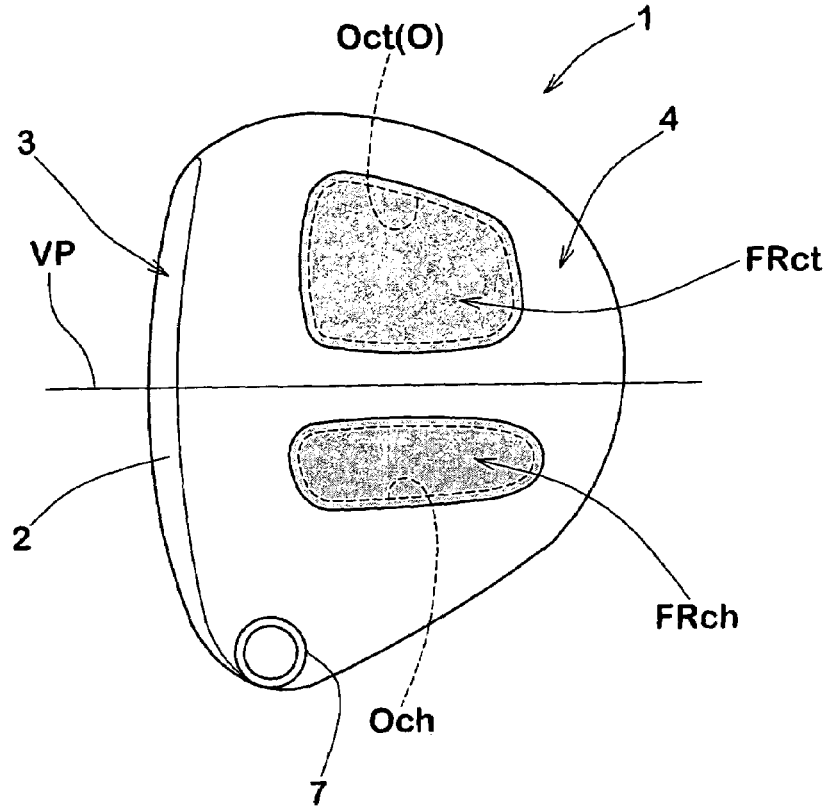
Figure 8B:
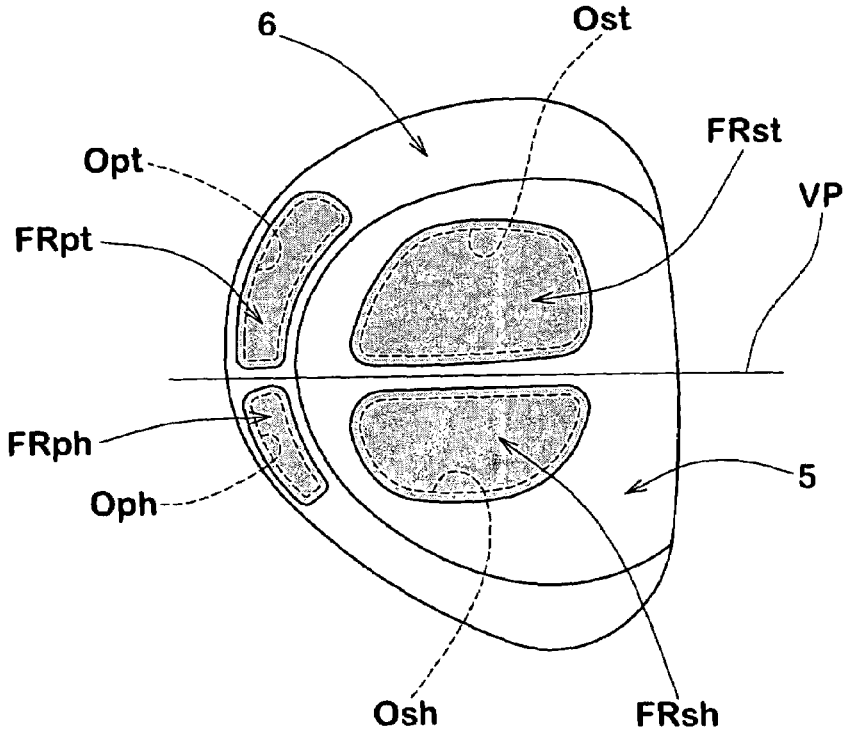

FIGS. 8A and 8B respectively show a plan view and a bottom plan view of a standard state as another embodiment of the head 1 in accordance with the present invention. In the head 1, there is exemplified a structure in which six opening portions O are provided in the head base body M. In other words, the crown portion 4 is provided with a toe side crown opening portion Oct and a heel side crown opening portion Och with respect to the vertical surface VP, and a toe side crown cover portion FRct and a heel side crown cover portion FRch are respectively arranged therein. Further, the sole portion 5 is provided with a toe side sole opening portion Ost and a heel side sole opening portion Osh with respect to the vertical surface VP, and a toe side sole cover portion FRst and a heel side sole cover portion FRsh are respectively arranged therein. Further, the side portion 6 is provided with a toe side side opening portion Opt and a heel side side opening portion Oph with respect to the vertical surface VP, and a toe side side cover portion FRpt and a heel side side cover portion FRph are respectively arranged therein.

As mentioned above, the opening portion O can be formed by being separated into a plurality of sections, however, it is necessary that the opening portion O is formed so as to include at least the crown portion 4, the sole portion 5 and the side portion 6. Further, although an illustration is omitted, the opening portion O may be, for example, formed by totally three opening portions which are respectively formed by one piece in the crown portion 4, the sole portion 5 and the side portion 6, or may be formed by two opening portions by connecting two pieces among them. Further, in the embodiment mentioned above, there is exemplified a structure in which the low specific gravity material is formed by the fiber reinforced resin, however, the structure is not limited to this.

EXAMPLES

In order to confirm the effect of the present invention, a wood type driver head having the head volume of 420 $cm^3$ is manufactured on the basis of the specification shown in Table 1. The head base body is integrally cast by using a titanium alloy (Ti-6Al-4V, specific gravity of about 4.4) for doing away with the dispersion, and thereafter precisely formed in the opening portion by applying a numerical control process. In all the examples, a receiving portion having a width of 5 mm and receiving the cover body is provided in the entire periphery around the opening portion. Further, the cover body is formed in accordance with an internal pressure molding method by using a prepreg obtained by impregnating a carbon fiber having an elastic modulus in tension of 275 GPa with an epoxy resin. Further, with respect to each of the heads, the following measurements and tests are carried out.

<Moment of Inertia>

In the standard state, the moment of inertia around the vertical axis passing through the head gravity point is measured by using MODEL NO. 005-002 of MOMENT OF INERTIA MEASURING INSTRUMENT manufactured by INERTIA DYNAMICS Inc.

<Directionality of Hit Ball>

The hitting test is carried out by employing twenty general (all right-handed) golfers having handicaps between 0 and 20, hitting five golf balls ("HI-BRID" manufactured by SRI Sports Co., Ltd.) by each of the trial golf clubs, and measuring a carry (carry+run), and right and left displacement amounts (right displacement is indicated by + and left displacement is indicated by −) of a carry drop position with respect to the target direction. All are expressed by average values of the five balls. Results of the test and the like are shown in Table 1.

TABLE 1

Figure 9A:
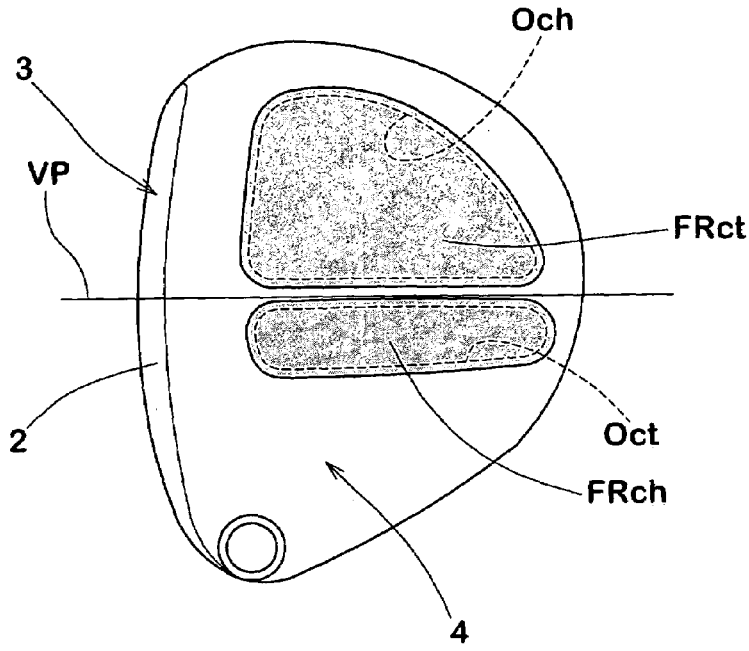
Figure 9B:
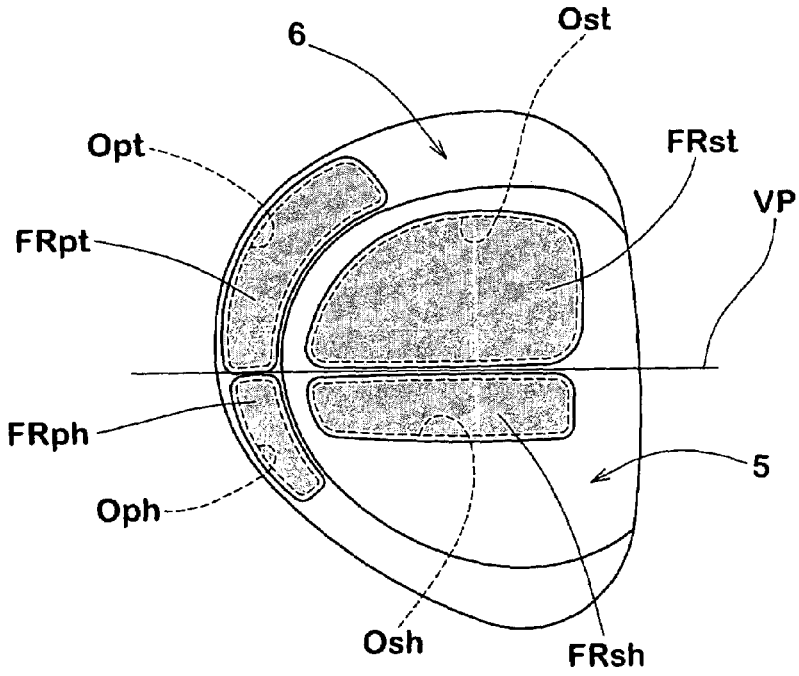
Figure 10A:
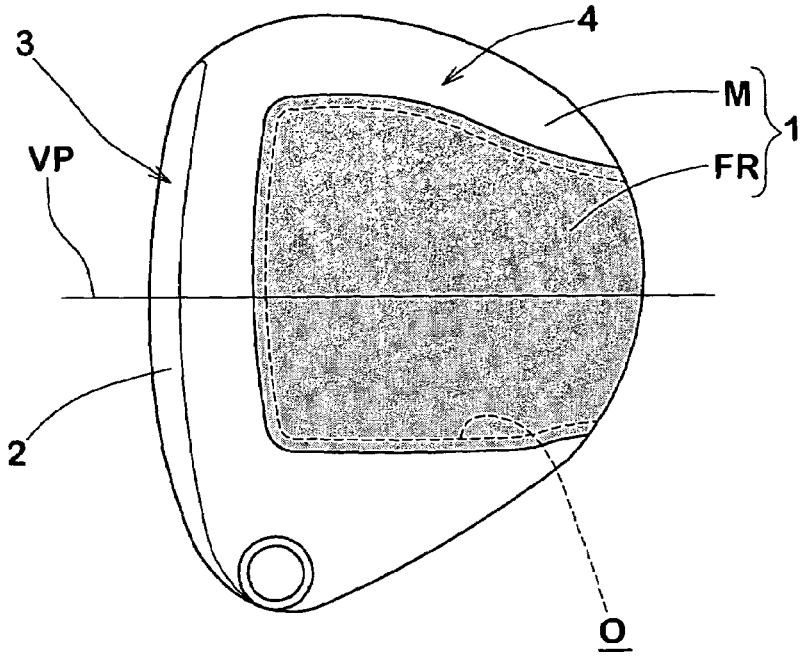
Figure 10B:
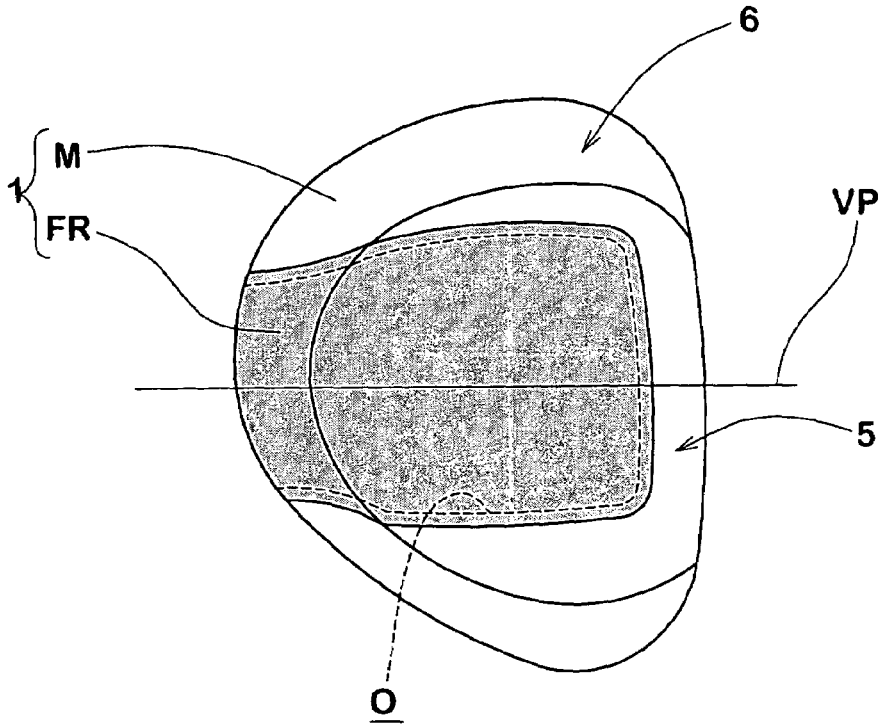
Figure 11A:
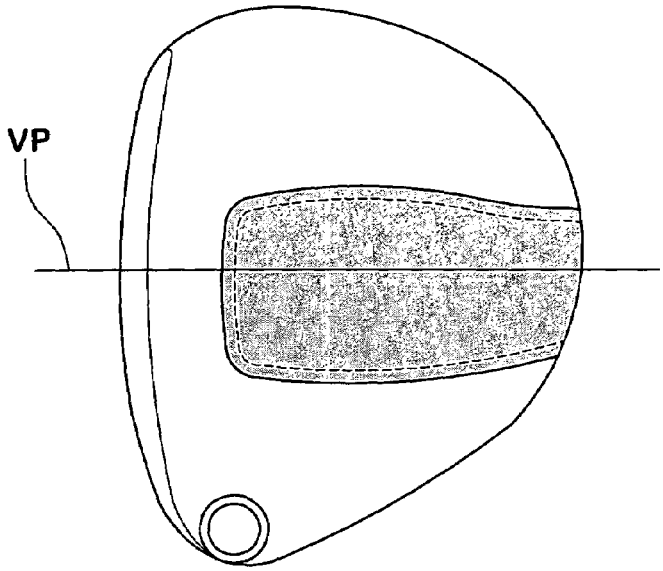
FIG. 11A is a plan view of a standard state.
Figure 11B:
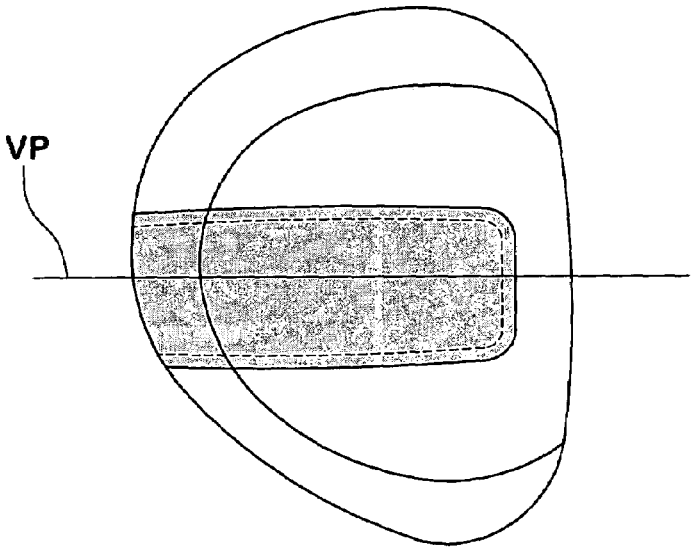
Figure 12A:
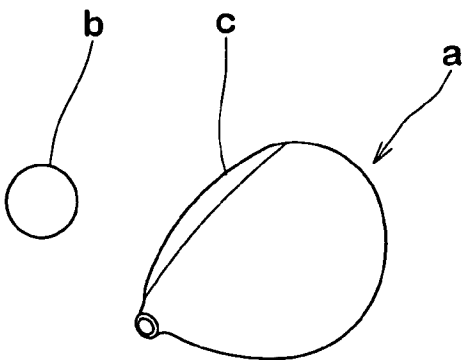
FIGS. 12A to 12C are plan schematic views showing a state of the head at the time of downswing.
Figure 12B:
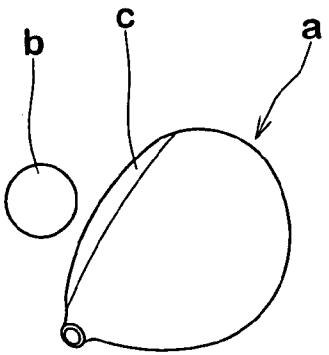
Figure 12C:
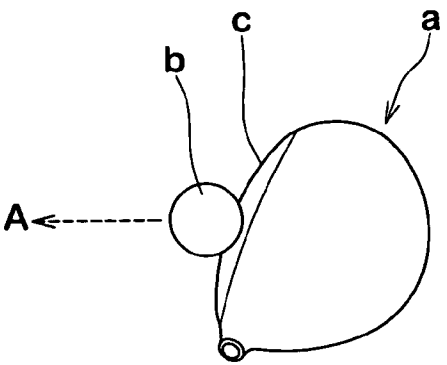

| | | Comparative Example 1 | Comparative Example 2 | Example 1 | Example 2 | Example 3 | Example 4 | Example 5 | Comparative Example 3 |
|---|---|---|---|---|---|---|---|---|---|
| View showing structure | | FIG. 11 | Based on FIG. 11 | FIG. 2 | FIG. 8 | FIG. 9 | Based on FIG. 9 | FIG. 10 | Based on FIG. 10 |
| Material of cover body | | Urethane foam | Duralumin | | | Fiber reinforced resin | | | |
| Specific gravity of cover body | | 0.7 | 2.8 | | | | 1.4 | | |
| Area ratio of cover body (Sh/St) [%] | | 120 | 130 | 50 | 60 | 40 | 30 | 70 | 120 |
| (Sh + St)/S | | 15 | 18 | 28 | 40 | 50 | 60 | 50 | 72 |
| Weight ratio Wh/W [%] | | 40 | 50 | 65 | 66 | 68 | 55 | 56 | 77 |
| Distance of gravity point L [mm] | | 50 | 46 | 37 | 30 | 28 | 27 | 30 | 60 |
| Test results | Directionality of hit ball (displacement amount) [m] | 25.1 | 20.2 | 15.3 | 10.1 | 8.3 | 6.7 | 5.0 | 30.5 |
| | Carry of hit ball [m] | 200.2 | 200.0 | 221.3 | 232.5 | 234.7 | 239.8 | 241.5 | 200.8 |
| | Moment of inertia (g · $cm^2$) | 2300 | 3000 | 3407 | 3650 | 3841 | 4203 | 4510 | 4000 |

As a result of the tests, it is known that the displacement amount of the hit ball in the right direction is widely reduced in the example in comparison with the comparative example. Accordingly, it is possible to confirm a significant effect of the present invention.

What is claimed is:

1. A golf club head comprising:

a face portion hitting a ball;

a crown portion connected to the face portion and forming an upper surface of the head;

a sole portion connected to said face portion and forming a head bottom surface;

a side portion extending between said crown portion and said sole portion from a toe of the face portion through a back face to a heel, and a neck portion having a shaft insertion hole, wherein the golf club head includes a head base body made of a metal material and provided with at least one opening portion, and a cover body arranged in said opening portion and made of a lower specific gravity material having a specific gravity smaller than said metal material, said head base body including said face portion, said neck portion, a crown main wall portion forming a main portion of said crown portion, a sole main wall portion forming a main portion of said sole portion, and a side main wall portion forming a main portion of said side portion, wherein said opening portion includes at least one of a crown opening portion open in said crown portion, a side opening portion open in said side portion and a sole opening portion open in said sole portion, wherein in a head toe side portion and a head heel side portion obtained by virtually sectioning the head by a vertical surface including a normal line drawn from the center of gravity of the head to the face surface in a standard state of being mounted on a horizontal surface at prescribed lie angle and loft angle, a surface area St of a portion of said cover body closing a portion of said opening portion which is located in said head toe side portion is made larger than a surface area Sh of the remaining portion of said cover body closing a portion of said opening portion which is located in said head heel side portion, and a weight Wh of the head heel side portion is set to 55 to 75% of the entire weight of the head, and wherein the shortest distance from the head's center of gravity to the axial center line of said shaft insertion hole is from 20 to 45 mm.

2. A golf club head as claimed in claim 1, wherein a specific gravity of said low specific gravity material is 1.0 to 2.0, and a specific gravity of said metal material is 4.0 to 10.0.

3. A golf club head as claimed in claim 1, wherein said low specific gravity material is constituted by a fiber reinforced resin.

4. A golf club head as claimed in claim 1, wherein in said standard state, a moment of inertia around a vertical axis passing through a head gravity point is 3300 to 5500 ($g \cdot cm^2$), and a head volume is 300 to 500 ($cm^3$).

5. A golf club head as claimed in claim 1, wherein said opening portion is structured such that said crown opening portion, said side opening portion and said sole opening portion are connected, and is constituted by one extending to said sole portion from said crown portion across said side portion on a rear side of the head.

6. A golf club head as claimed in claim 1, wherein said head base body has a single opening portion formed in at least one of said crown portion, said side portion and said sole portion.

7. A golf club head comprising:

a head base body including a face portion hitting a ball, a crown portion connected to said face portion and forming an upper surface of the head, a sole portion connected to said face portion and forming a head bottom surface, a side portion extending between said crown portion and said sole portion from a toe of said face portion through a back face to a heel, and a neck portion having a shaft insertion hole, and having at least one opening portion fonned in at least one of said crown portion, said side portion and said sole portion; and a cover body arranged in said opening portion, wherein said head base body is made of a metal material, and said cover body is made of a composite material having a specific gravity smaller than said metal material and comprising a matrix resin and a fiber as a reinforcing material having an elastic modulus of 200 to 460 GPa, wherein in a head toe side portion and a head heel side portion obtained by virtually sectioning the head by a vertical surface including a normal line drawn from the head's center of gravity to the face surface in a standard state of being placed on a horizontal surface at prescribed lie angle and loft angle, the surface area St of a portion of said cover body closing a portion of said opening portion which is located in said head toe side portion is larger than the surface area Sh of the remaining portion of said cover body closing a portion of said opening portion which is located in said head heel side portion, and the weight Wh of the head heel side portion is from 55 to 75% of the entire weight of the head, and wherein the shortest distance from the head's center of gravity to the axial center line of said shaft insertion hole is from 20 to 45 mm.

8. A golf club head as claimed in claim 7, wherein said head base body has a single opening portion extending from said crown portion to said sole portion through said side portion on a rear side of the head.

9. A golf club head comprising:

a face portion hitting a ball;

a crown portion connected to the face portion and forming an upper surface of the head;

a sole portion connected to said face portion and forming a head bottom surface; and a side portion extending between said crown portion and said sole portion from a toe of the face portion through a back face to a heel, wherein the golf club head includes a head base body made of a metal material and provided with at least one opening portion, and a cover body arranged in said opening portion and made of a lower specific gravity material having a specific gravity smaller than said metal material, wherein said opening portion includes at least one of a crown opening portion open in said crown portion, a side opening portion open in said side portion and a sole opening portion open in said sole portion, wherein in a head toe side portion and a head heel side portion obtained by virtually sectioning the head by a vertical surface including a normal line drawn from the head's center of gravity to the face surface in a standard state of being mounted on a horizontal surface at prescribed lie angle and loft angle, a surface area St of a portion of said cover body closing a portion of said opening portion which is located in said head toe side portion is larger than a surface area Sh of the remaining portion of said cover body closing a portion of said opening portion which is located in said head heel side portion, and a weight Wh of the head heel side portion is set to 55 to 75% of the entire weight of the head, and wherein said at least one opening portion is formed so that said crown opening portion, said side opening portion and said sole opening portion are connected to form a single opening extending from said crown portion to said sole portion across said side portion on a rear side of the head.

10. A golf club head as chimed in claim 9, wherein said cover body is in the form of a band.

* * * * *